US011006197B1

(12) United States Patent
Khaleghimeybodi

(10) Patent No.: US 11,006,197 B1
(45) **Date of Patent: *May 11, 2021**

(54) EAR-PLUG DEVICE WITH IN-EAR CARTILAGE CONDUCTION TRANSDUCER

(71) Applicant: Facebook Technologies, LLC, Menlo Park, CA (US)

(72) Inventor: Morteza Khaleghimeybodi, Bothell, WA (US)

(73) Assignee: Facebook Technologies, LLC, Menlo Park, CA (US)

( * ) Notice: Subject to any disclaimer, the term of this patent is extended or adjusted under 35 U.S.C. 154(b) by 53 days.

This patent is subject to a terminal disclaimer.

(21) Appl. No.: 16/669,335

(22) Filed: Oct. 30, 2019

(51) Int. Cl.

| | |
|---|---|
| ***H04R 1/10*** | (2006.01) |
| ***H04R 17/00*** | (2006.01) |
| ***H04R 1/34*** | (2006.01) |
| ***H04R 1/08*** | (2006.01) |
| ***H04R 25/00*** | (2006.01) |

(52) U.S. Cl.
CPC ..... *H04R 1/1016* (2013.01); *H04R 1/08* (2013.01); *H04R 1/1041* (2013.01); *H04R 1/345* (2013.01); *H04R 17/00* (2013.01); *H04R 25/656* (2013.01); *H04R 2225/023* (2013.01); *H04R 2460/13* (2013.01)

(58) Field of Classification Search
CPC ..... H04R 1/1016; H04R 1/08; H04R 1/104; H04R 1/345; H04R 25/656; H04R 2225/023; H04R 17/00; H04R 2460/13; H04R 1/1041
USPC ..... 381/74, 151, 380
See application file for complete search history.

(56) References Cited

U.S. PATENT DOCUMENTS

| | | | | |
|---|---|---|---|---|
| 10,356,231 | B2 | 7/2019 | Hosoi et al. | |
| 2006/0159297 | A1* | 7/2006 | Wirola | H04R 1/1016 381/328 |
| 2017/0188126 | A1* | 6/2017 | Hirano | H04R 1/105 |
| 2017/0228995 | A1* | 8/2017 | Hosoi | G08B 21/02 |

* cited by examiner

*Primary Examiner* — Vivian C Chin
*Assistant Examiner* — Douglas J Suthers
(74) *Attorney, Agent, or Firm* — Fenwick & West LLP

(57) ABSTRACT

An ear-plug device is an in-ear device that presents audio content to an ear canal of a user. The in-ear device includes a body configured to at least partially fit inside the ear canal of the user, and a transducer assembly coupled to the body. The transducer assembly comprises at least one transducer located within the ear canal. The at least one transducer is configured to vibrate a portion of the ear canal to cause the ear canal to create an airborne acoustic pressure wave in the ear canal in accordance with vibration instructions. The airborne acoustic pressure wave corresponds to and is for presentation of the audio content to the user.

20 Claims, 9 Drawing Sheets

200

EAR-PLUG DEVICE WITH IN-EAR CARTILAGE CONDUCTION TRANSDUCER

BACKGROUND

The present disclosure generally relates to an audio system in a headset, and specifically relates to an ear-plug device with an in-ear cartilage conduction transducer for use in a headset.

Headsets often include features such as audio systems to provide audio content to users of the headsets. Conventionally, a user of the headset wears headphones to receive, or otherwise experience, computer generated sounds. However, a sound pressure created in an ear canal can vary on user basis due to a unique anatomy of a user's pinna. Furthermore, a high-frequency sound leakage can occur when delivering audio content to a user, which puts the private audio delivery at risk.

SUMMARY

An ear-plug device is configured to present a user with improved audio content. The ear-plug device is configured to at least partially fit inside a user's ear canal. The ear-plug device includes a body and a transducer assembly coupled to the body that at least partially fits inside the ear canal. The transducer assembly including at least one transducer located within the ear canal. The at least one transducer vibrates a portion of the ear canal to cause the ear canal to create an airborne acoustic pressure wave in the ear canal in accordance with vibration instructions. The airborne acoustic pressure wave corresponds to and is for presentation of audio content to the user.

In some embodiments, a method for presenting improved audio content via the ear-plug assembly is disclosed. The method includes generating vibration instructions using audio content, and vibrating, by the transducer assembly located within an ear canal of a user, a portion of the ear canal to cause the ear canal to create an airborne acoustic pressure wave in the ear canal in accordance with the vibration instructions.

Figure 1:
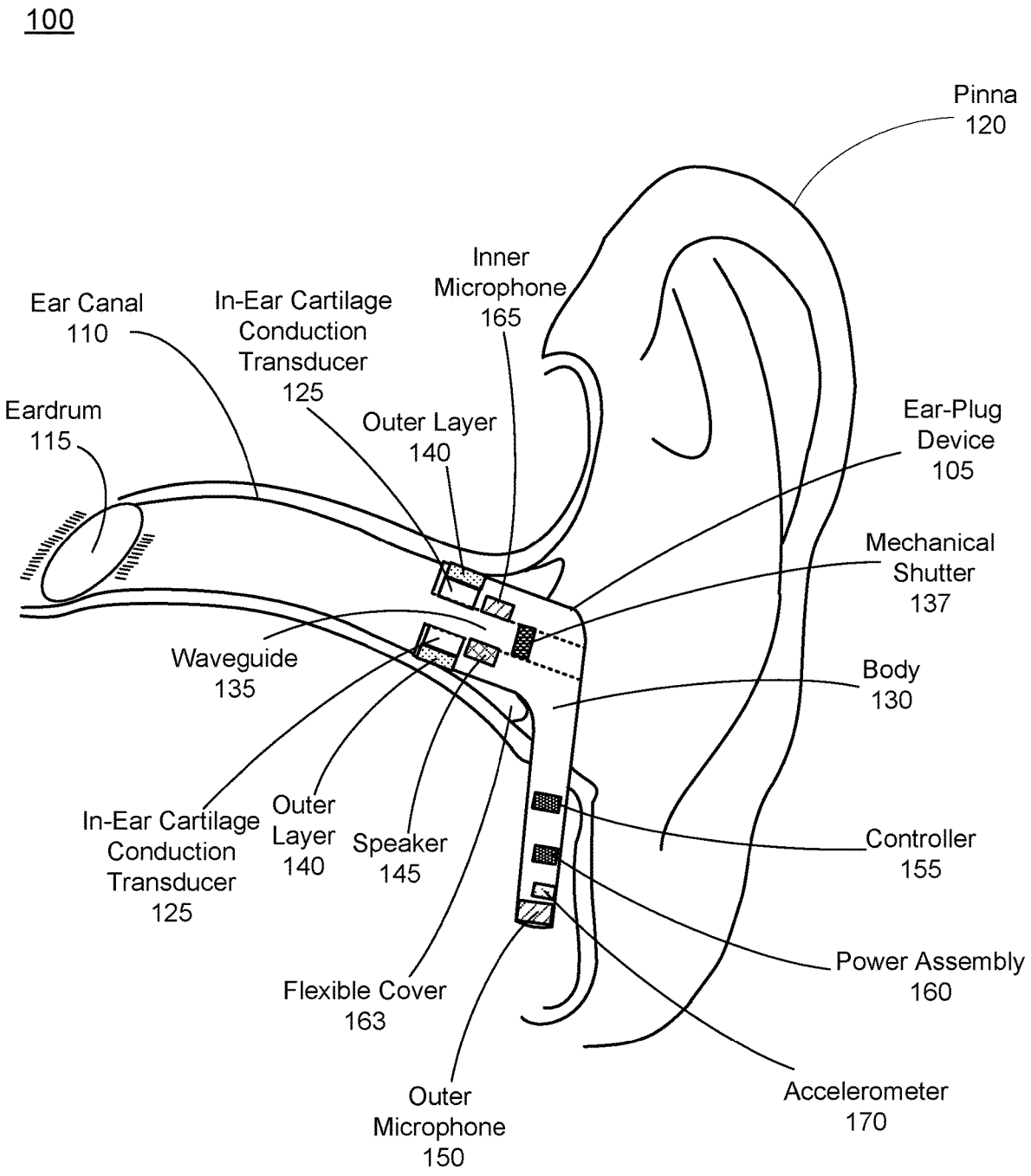
FIG. 1 is a cross-sectional view of an ear-plug device within a user's ear canal, in accordance with one or more embodiments.

The figures depict various embodiments for purposes of illustration only. One skilled in the art will readily recognize from the following discussion that alternative embodiments of the structures and methods illustrated herein may be employed without departing from the principles described herein.

DETAILED DESCRIPTION

An ear-plug device that presents improved audio content to a user is presented herein. The ear-plug device comprises a number of components that may be coupled to a body. The ear-plug device is designed with a sufficiently small form-factor to at least partially fit inside an ear canal of the user. In addition to the body, the ear-plug device comprises a transducer assembly with a cartilage conduction transducer, at least one acoustic sensor (e.g., microphone), and a waveguide, among other components. The ear-plug device also includes a controller and a power assembly. Optionally, the ear-plug device may also include at least one speaker for generating sounds inside the ear canal.

The cartilage conduction transducer of the ear-plug device is located within the ear canal. The cartilage conduction transducer vibrates a portion of the ear canal to cause the ear canal to create airborne acoustic pressure waves in the ear canal. In some embodiments, the cartilage conduction transducer operates in a radial vibrational mode, i.e., the cartilage conduction transducer vibrates the ear canal in a radial direction along a radius orthogonal to a central axis of the ear canal. In some other embodiments, the cartilage conduction transducer operates in a transverse vibrational mode, i.e., the cartilage conduction transducer vibrates the ear canal in a transverse direction parallel to the central axis of the ear canal. The transducer assembly includes an outer layer designed to ensure efficient coupling of the transducer assembly to the ear canal, as well as to improve fit and comfort. The outer layer may be also configured to mitigate impedance mismatch between the cartilage conduction transducer and a tissue of the ear canal.

The ear-plug device may be configured to operate as an open-ear device that propagates sounds from a local area outside of the ear canal into the ear canal. Alternatively, the ear-plug device may be configured to operate as a closed-ear device that attenuates sounds from the local area outside of the ear canal. In some embodiments, the ear-plug device may be switched from an-open ear device configuration to a closed-ear device configuration and vice versa. The ear-plug device includes at least one external microphone that collects sounds from the local area. In some embodiments, the external microphone may be placed at a proximity to an entrance to the ear canal. The ear-plug device may also include, among other components, one or more internal microphones that collect sounds from within the ear canal, and one or more internal speakers that emit sounds within the ear canal. The ear-plug device presented herein provides for efficient preloading (i.e., putting the cartilage conduction transducer in place with a tissue of the ear canal) based on a pressure from ear canal walls to the cartilage conduction transducer (i.e., the tight fit inside the ear canal provides preloading). Thus, the ear-plug device presented herein does not require any additional preloading mechanism.

Embodiments of the invention may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, and any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to, e.g., create content in an artificial reality and/or are otherwise used in (e.g., perform activities in) an artificial reality. The artificial reality system that provides the artificial reality content may be implemented on various platforms, including a headset (e.g., head-mounted display (HMD) and/or near-eye display (NED)) connected to a host computer system, a standalone headset, a mobile device or computing system, or any other hardware platform capable of providing artificial reality content to one or more viewers.

System Overview

FIG. 1 is a cross-sectional view 100 of an ear-plug device 105 within a user's ear canal 110, in accordance with one or more embodiments. The ear-plug device 105 presents audio content to a user using an in-ear cartilage conduction transducer 125. The cross-sectional view 100 includes components of an ear of the user, including, an ear canal 110, an eardrum 115, and a pinna 120. The ear-plug device 105 includes a body 130, a waveguide 135, the in-ear cartilage conduction transducer 125 with an outer layer 140, an outer microphone 150 with an optional accelerometer 170, a flexible cover 163, a controller 155, and a power assembly 160. In some embodiments, the ear-plug device 105 includes a speaker 145 and/or an inner microphone 165. A portion of the ear-plug device 105 fits within the ear canal 110 of the user's ear, such that the in-ear cartilage conduction transducer 125 is able to present audio content within the ear canal 110, to the eardrum 115.

The body 130 couples to a number of other components of the ear-plug device 105. The body 130 is configured to at least partially fit within the ear canal 110, and couples to the in-ear cartilage conduction transducer 125, the outer microphone 150, the speaker 145, and in some embodiments, the inner microphone 165 and a mechanical shutter 137. At least a portion of the body 130 fits within the ear canal 110 of the user's ear, while the remaining portion of the body 130 may be outside of the ear canal 110. In some embodiments, the portion of the body 130 that fits within the ear canal 110 of the user's ear may be shaped like a nozzle. The nozzle improves the quality of sound presented to the user, particularly for high frequency sounds. The body 130 may be formed of one or more materials that attenuate sound from a local area outside the ear canal 110, ensuring that the user is able to better hear the audio content produced by the in-ear cartilage conduction transducer 125 and/or the speaker 145. For example, the body 130 may be composed of foam, silicone, plastic, rubber, or some combination thereof. In FIG. 1, the body 130 is substantially cylindrical with rounded ends, but in other embodiments, the body 130 may be of other geometries.

The body 130 may be partially enclosed by the flexible cover 163. The flexible cover 163 prevents the leakage of audio content presented by the in-ear cartilage conduction transducer 125 and the speaker 145 within the ear canal 110. The flexible cover 163 seals the portion of the body 130 that fits within the ear canal 110, fitting to the shape of the ear canal 110. The flexible cover 163 may be composed of some sound insulating material, such as foam, silicone, or some combination thereof. The flexible cover 163 may have a form resembling a generic ear-plug. In some embodiments, the flexible cover 163 may be customized for the shape of the user's ear canal, thereby enhancing the attenuation of unwanted sounds, such as external loud noises. A customized flexible cover 163 may improve the fit and stability of the ear-plug device 105 within the user's ear. In some embodiments, a portion of the flexible cover 163 may be composed of metal, such as aluminum, steel, or some combination thereof. A heavier flexible cover 163 results in improved attenuation of unwanted sounds by reducing background noise and increasing the signal to noise ratio delivered to the eardrum 115 of the user's ear. Accordingly, a heavier flexible cover 163 improves the quality of sound presented to the user, delivering a more convincing hear-through experience. In some embodiments, a portion of the flexible cover 163 or the entire flexible cover 163 is removeable.

The in-ear cartilage conduction transducer 125 is located within the ear canal 110 and vibrates a portion of the ear canal 110 (e.g., a cartilage that makes up the ear canal 110) to cause the ear canal 110 to create one or more airborne acoustic pressure waves in the ear canal 110, e.g., in accordance with vibration instructions from the controller 155. The one or more airborne acoustic pressure waves generated by the in-ear cartilage conduction transducer 125 corresponds to and is for presentation of audio content to the user. The in-ear cartilage conduction transducer 125 presents the audio content within the ear canal 110 such that the one or more airborne acoustic pressure waves vibrates the eardrum 115 and passes through a middle ear ossicular chain of the user's ear to a cochlea of the user's inner ear. The cochlea of the user perceives the vibrations as the audio content.

In an embodiment, the in-ear cartilage conduction transducer 125 is configured to vibrate a tissue (e.g., a cartilage) of the ear canal 110 in a radial direction for creating the airborne acoustic pressure wave, the radial direction pointing along a radius orthogonal to a central axis of the ear canal 110. In another embodiment, the in-ear cartilage conduction transducer 125 is configured to vibrate the tissue of the ear canal 110 in a transverse direction pointing parallel to a central axis of the ear canal 110 for creating the airborne acoustic pressure wave.

The in-ear cartilage conduction transducer 125 may include an outer surface that has a radius of curvature such that the in-ear cartilage conduction transducer 125 fits within the ear canal 110. The in-ear cartilage conduction transducer 125 may be coupled to the ear canal 110 via the outer layer 140. The outer layer 140 may be made of a material designed to reduce an impedance mismatch between the in-ear cartilage conduction transducer 125 and a tissue of the ear canal 110 below, e.g., a threshold level. In some embodiments, the outer layer 140 comprises a material with a mechanical impedance between a mechanical impedance of a tissue of the ear canal 110 and a mechanical impedance of the in-ear cartilage conduction transducer 125. The outer layer 140 then acts as an impedance matching layer to reduce the impedance mismatch between the in-ear cartilage conduction transducer 125 and the tissue, and thereby improving the energy transfer from the in-ear cartilage conduction transducer 125 to the tissue of the ear canal 110. Alternatively, the outer layer 140 comprises a viscoelastic silicone material with an overall hardness between approximately 25 Shore A durometers nd 70 Shore A durometers.

In one embodiment, the in-ear cartilage conduction transducer 125 is implemented as a piezoelectric transducer. In another embodiment, the in-ear cartilage conduction transducer 125 is implemented as a moving coil transducer. In yet another embodiment, the in-ear cartilage conduction transducer 125 is implemented as an electrostatic transducer. In some embodiments, the ear-plug device 105 may include multiple in-ear cartilage conduction transducers 125 placed within the ear canal 110 to cover different parts of a frequency range. For example, a piezoelectric transducer may be used to cover a first part of a frequency range and a moving coil transducer may be used to cover a second part of a frequency range.

The waveguide 135 is an opening in the ear-plug device 105 that guides sounds to, e.g., the eardrum 115. The waveguide 135 may facilitate propagation of sounds from a local area outside of the ear canal 110 into the ear canal 110 and the eardrum 115. Also, the waveguide 135 may guide airborne acoustic pressure waves generated by the speaker 145 toward the eardrum 115. The waveguide 135 is positioned along the body 130 and may be partially located within the ear canal 110 and partially outside of the ear canal 110. The waveguide 135 may be an opening in the body 130, a tube, a channel, or some combination thereof.

In some embodiments, the ear-plug device 105 includes a controllable block configured to attenuate the sounds from the local area propagating through the waveguide 135 into the ear canal 110, wherein an amount of attenuation is based on a state of the controllable block. The controllable block may be implemented as the mechanical shutter 137 that obstructs the waveguide 135. The amount of obstruction is based on the state of the mechanical shutter 137, which may be controlled by, e.g., the controller 155 via one or more mechanical actuators coupled to the mechanical shutter 137.

Based on a state of the controllable block (e.g., the mechanical shutter 137), the ear-plug device 105 may be configured to operate as an open-ear device that propagates sounds from the local area outside of the ear canal 110 into the ear canal 110 (e.g., user's speech). Alternatively, the ear-plug device 105 may be configured to operate as a closed-ear device that attenuates sounds (e.g., noise) from the local area outside of the ear canal 110. In some embodiments, the ear-plug device 105 may be switched from an-open ear device configuration to a closed-ear device configuration and vice versa, e.g., based on instructions from the controller 155 or manually by the user. The user may actively select the closed-ear device configuration for, e.g., a more immersive music, a private phone call, etc.

The outer microphone 150 monitors and detects acoustic pressure waves (sounds) from the local area outside the ear canal 110. The outer microphone 150 is positioned within the body 130 of the ear-plug device 105 such that to capture sounds from the local area. The outer microphone 150 may transmit the acoustic data it detects to the controller 155 of the ear-plug device 105. In an embodiment, the outer microphone 150 is positioned at an entrance of the ear canal 110. The controller 155 may use sound data collected by the outer microphone 150 at the entrance of the ear canal 110 to determine a head-related transfer function (HRTF). In another embodiment, the outer microphone 150 is positioned closer to a mouth of the user, e.g., for improved detection of user's speech. In some embodiments, instead of the outer microphone 150, the ear-plug device 105 may include, for example, an accelerometer, other acoustic sensors, or some combination thereof. In some embodiments, the body 130 includes a plurality of acoustic sensors, at least one of which may be placed on a surface of the body 130 outside of the ear canal 110.

In some embodiments, the ear-plug device 105 includes the accelerometer 170 positioned on the body 130 in a vicinity of the outer microphone 150. The accelerometer 170 may be implemented as a bone conduction accelerometer, and configured to measure acceleration data associated with vibration of bones in a head of the user caused by detected sounds from the local area outside of the ear canal 110 (e.g., user's speech). When the user speaks, in addition to the sound created by the user's mouth, tissue vibrations are also created emanating from the user's mouth. The tissue vibrations may quickly propagate and reach the ear-plug device 105, and can be detected by the bone conduction accelerometer 170. The bone conduction accelerometer 170 can enhance voice detection in crowded areas where typical microphones may be less efficient due to a relatively low level of signal-to-noise ratio (SNR). In such cases, the bone conduction accelerometer 170 can be utilized with or without the outer microphone 150, and the voice detection performance can be improved by, e.g., approximately 20 dB.

In some embodiments, the body 130 includes the inner microphone 165, which detects sound transmitted via tissue conduction (e.g., from the in-ear cartilage conduction transducer 125), sound transmitted via air conduction (e.g., from the speaker 145 and/or the local area), or combination thereof. The inner microphone 165 may also detect the user's own voice. The user's own voice may be amplified due to occlusion of the ear canal 110 by the ear-plug device 105. The inner microphone 165 may transmit the acoustic data it detects to the controller 155 of the ear-plug device 105. In one or more embodiments, instead of the inner microphone 165, the ear-plug device 1005 may include an accelerometer, or another sensor that detects acoustic pressure waves inside the ear canal 110.

In addition to the outer microphone 150 and the inner microphone 165, the ear-plug device 105 may include a plurality of sensors designated for use other than measuring audio data and/or a plurality of acoustic sensors substantially similar to the outer microphone 150 and the inner microphone 165 described herein. For example, other sensors within the ear-plug device 105 may include initial measurement units (IMUs), gyroscopes, position sensors, or a combination thereof.

The speaker 145 is an air conduction transducer that presents audio content within the ear canal 110 of the user, as per instructions received by the controller 155. The speaker 145 may present audio content based in part on the sound from the local area around the user, detected by the outer microphone 150. In some embodiments, the speaker 145 may present audio content based in part on the sound detected by the inner microphone 165. In some embodiments, the controller 155 may instruct the speaker 145 to amplify, attenuate, augment, and/or filter the sound detected from the local area of the user. For example, the speaker 145 may present augmented audio content to the user for use in a VR and AR headset. In one or more embodiments, the speaker 145 generate airborne acoustic pressure waves in the ear canal 110 to attenuate unwanted sounds (e.g., noise)

from the local area propagating through the waveguide 135 into the ear canal 110, e.g., based on instructions from the controller 155.

The speaker 145 presents audio content within the ear canal 110 such that the sound vibrates the eardrum 115 and passes through a middle ear ossicular chain of the user's ear to a cochlea of the user's inner ear. The cochlea of the user perceives the vibrations as audio content. The speaker 145 may present the audio content via air conduction. With air conduction, the speaker 145 creates airborne acoustic pressure waves and sends them to the eardrum of the user, which vibrates and is detected by the cochlea of the user. In one embodiment, the speaker 145 may produce sounds together with the in-ear cartilage conduction transducer 125. For example, the speaker 145 may produce a portion of audio above a threshold frequency (i.e., high frequency audio content) while the in-ear cartilage conduction transducer 125 may produce a portion of audio below the threshold frequency (i.e., low frequency audio content). In another embodiment, the speaker 145 may provide active-noise cancellation for some of the ambient noise.

The speaker 145 is located within the body 130, proximate to the waveguide 135 such that acoustic pressure waves generated by the speaker 145 are propagated at least partially via the waveguide 135 into the eardrum 115 of the user's ear. The speaker 145 may be coupled to a portion of the body 130. Coupling may be such that there is indirect and/or direct contact between the speaker 145 and the body 130. In some embodiments, more than one speaker 145 is positioned on a portion of a surface of the body 130 of the ear-plug device 105 inside the ear canal 110.

The controller 155 may control operations of various components the ear-plug device 105. The controller 155 may generate vibration instructions using audio content. The controller 155 may provide the vibration instructions to the in-ear cartilage conduction transducer 125 causing vibrations of a portion of the ear canal 110 that create airborne acoustic pressure waves in the ear canal 110 that are perceived as sounds by the eardrum 115. The controller 155 may be positioned within the body 130, such as within the portion of the body 130 outside the ear canal 110 of the user. In other embodiments, the controller 155 may be positioned within the portion of the body 130 configured to fit inside the ear canal 110.

The controller 155 may receive and process sound data detected by acoustic sensors mounted on the ear-plug device 105, such as the outer microphone 150 and the inner microphone 165. The controller 155 may update the vibration instructions based at least in part on the detected sound data. The controller 155 may instruct the in-ear cartilage conduction transducer 125 and/or the speaker 145 to present audio content based in part on the sound from the local area detected by the outer microphone 150 and sound transmitted via tissue conduction, detected by the inner microphone 165. For example, the controller 155 may amplify the sound from the local area, resulting in the in-ear cartilage conduction transducer 125 and/or the speaker 145 presenting louder sound from the local area within the ear canal 110. In another embodiment, the controller 155 may instruct the in-ear cartilage conduction transducer 125 and/or the speaker 145 to present sound from the local area from a large bandwidth, resulting in an increase in the range of frequencies the user is able to hear. For use in artificial reality applications, the controller 155 may include sound filters to augment the sound detected from the local area. For example, the sound filters may be used to spatialize sound such that it appears to originate from a virtual object being presented to the user while also rebroadcasting sound from a local area of the user.

The controller 155 may instruct the speaker 145 to generate one or more airborne acoustic pressure waves in the ear canal 110 to attenuate the sounds (e.g., noise) from the local area propagating through the waveguide 135 into the ear canal 110. The controller 155 may also control (e.g., via mechanical actuators) a state of the mechanical shutter 137 that at least partially obstructs the waveguide 135 to attenuate the sounds from the local area propagating into the ear canal 110, wherein an amount of obstruction is based on the state of the mechanical shutter 137 controlled by the controller 155.

The controller 155 may also attenuate sound detected by the inner microphone 165. For example, the inner microphone 165 may detect sounds of the user's voice getting amplified, when the acoustic pressure waves from their speech get transmitted through tissue and/or bone of the user. The user's voice may get amplified due to the ear-plug device 105 occluding the user's ear canal 110. The controller 155 may subsequently instruct the speaker 145 to attenuate the sounds of the user's own voice when presenting audio content. Accordingly, the user may perceive their own voice with more clarity and more naturally, while also perceiving the presented audio content. In another embodiment, the controller 155 may amplify and/or attenuate sounds detected from the local area that fall within a range of frequencies. For example, in a noisy environment near a train station, the speaker 145 may attenuate high frequency train whistles when presenting audio content to the user's ear canal 110 based on instructions from the controller 155.

The power assembly 160 provides power to the ear-plug device 105. The power may be used to power the controller 155, the in-ear cartilage conduction transducer 125, the outer microphone 150, the inner microphone 165, and the speaker 145 in the ear-plug device 105. The power assembly 160 may be a battery, for example. In some embodiments, there are one or more power assemblies 160 for some or all of the components of the ear-plug device 105. In some cases, the power assembly 160 is a rechargeable battery.

Figure 2A:
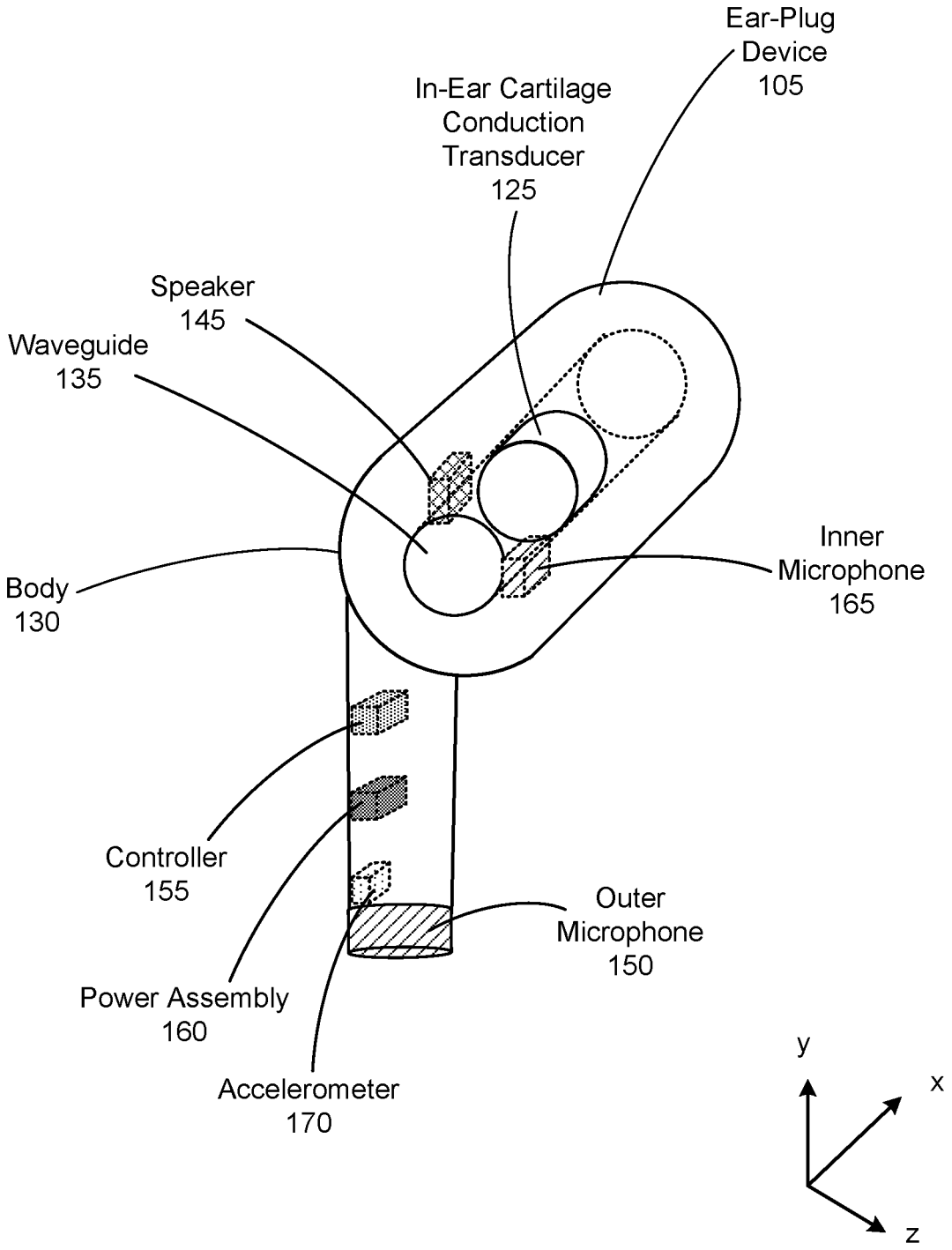
FIG. 2A is a perspective view of an ear-plug device, in accordance with one or more embodiments.

FIG. 2A is a perspective view 200 of the ear-plug device 105, in accordance with one or more embodiments. The perspective view 200 shows the components of the ear-plug device 105 depicted in FIG. 1. For simplicity, the perspective view 200 omits the flexible cover 163 used to fit the ear-plug device 105 to the ear canal 110 that is shown in FIG. 1.

Figure 2B:
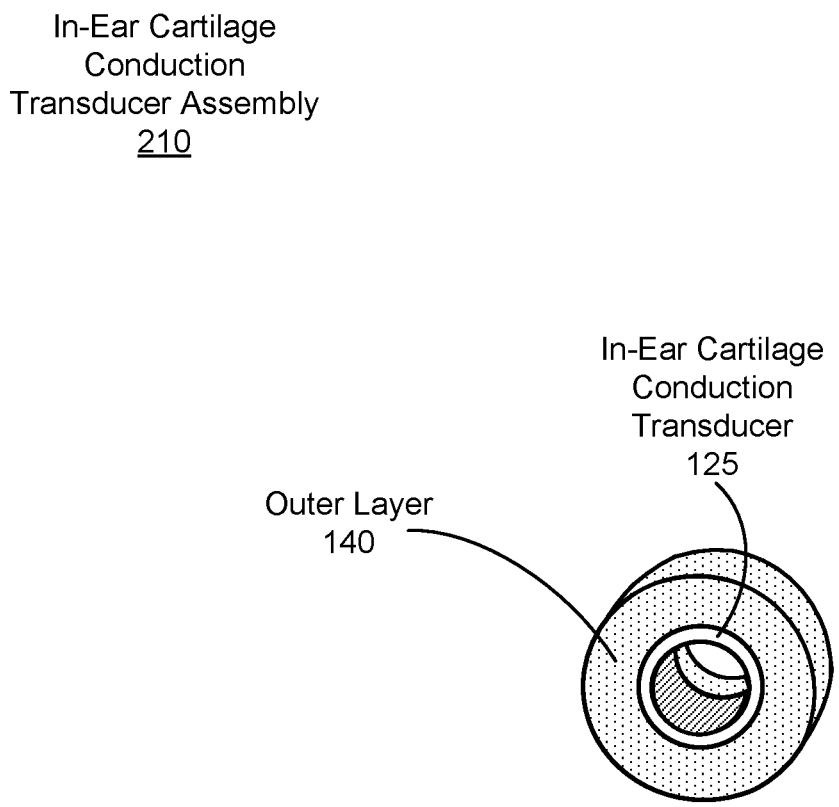
FIG. 2B is a perspective view of an in-ear cartilage conduction transducer assembly of the ear-plug device of FIG. 2A, in accordance with one or more embodiments.

FIG. 2B is a perspective view of an in-ear cartilage conduction transducer assembly 210 of the ear-plug device 105, in accordance with one or more embodiments. The ear cartilage conduction transducer assembly 210 includes the in-ear cartilage conduction transducer 125 and the outer layer 140. As shown in FIG. 2B, the in-ear cartilage conduction transducer assembly 210 may have a radial geometry, i.e., the in-ear cartilage conduction transducer assembly 210 has an outer surface that has a radius of curvature such that the in-ear cartilage conduction transducer 125 fits within the ear canal (e.g., the ear canal 110) of the user. In some embodiments (not shown in FIG. 2B), the in-ear cartilage conduction transducer assembly 210 may have an elliptical geometry, rectangular geometry, square geometry, free-form geometry, or some other suitable geometry. In some other embodiments (not shown in FIG. 2B), the in-ear cartilage conduction transducer assembly 210 includes a plurality of transducers within a ring structure instead of a single transducer.

Figure 3A:
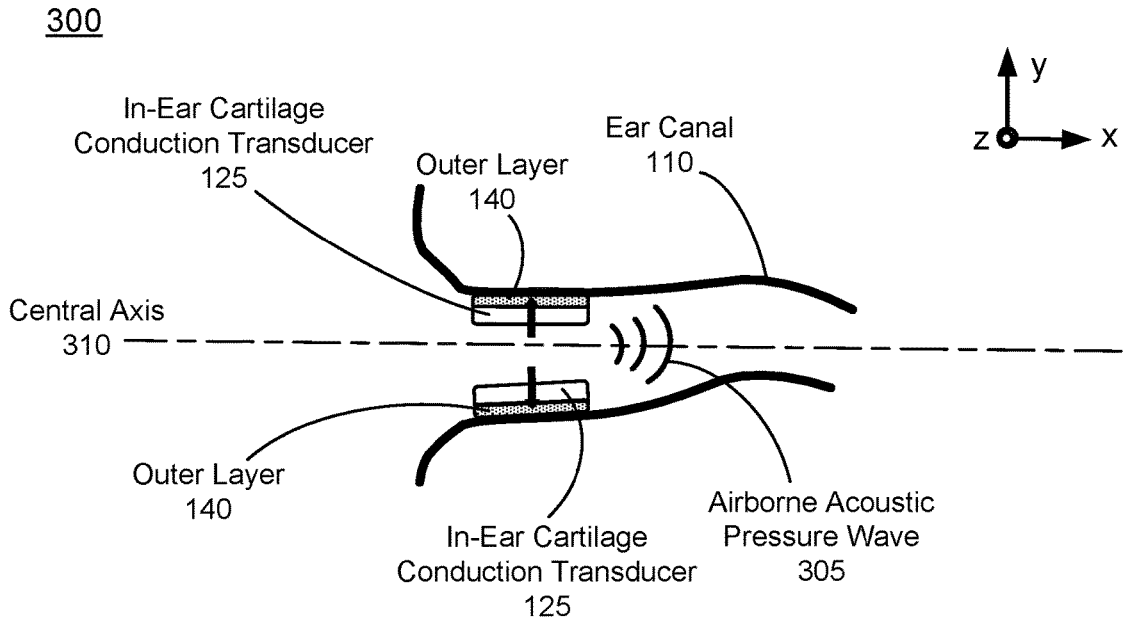
FIG. 3A is a cross-sectional view of an in-ear cartilage conduction transducer assembly operating in a radial vibration mode, in accordance with one or more embodiments.

FIG. 3A is a cross-sectional view 300 of the in-ear cartilage conduction transducer 125 operating in a radial vibration mode, in accordance with one or more embodiments. The in-ear cartilage conduction transducer 125 may vibrate, via the outer layer 140, a tissue of the ear canal 110 in one or more radial directions (e.g., parallel with a y dimension in FIG. 3A) for creating an airborne acoustic pressure wave 305 within the ear canal 110. A radial direction can be defined as a direction pointing along a radius orthogonal to a central axis 310 of the ear canal 110.

Figure 3B:
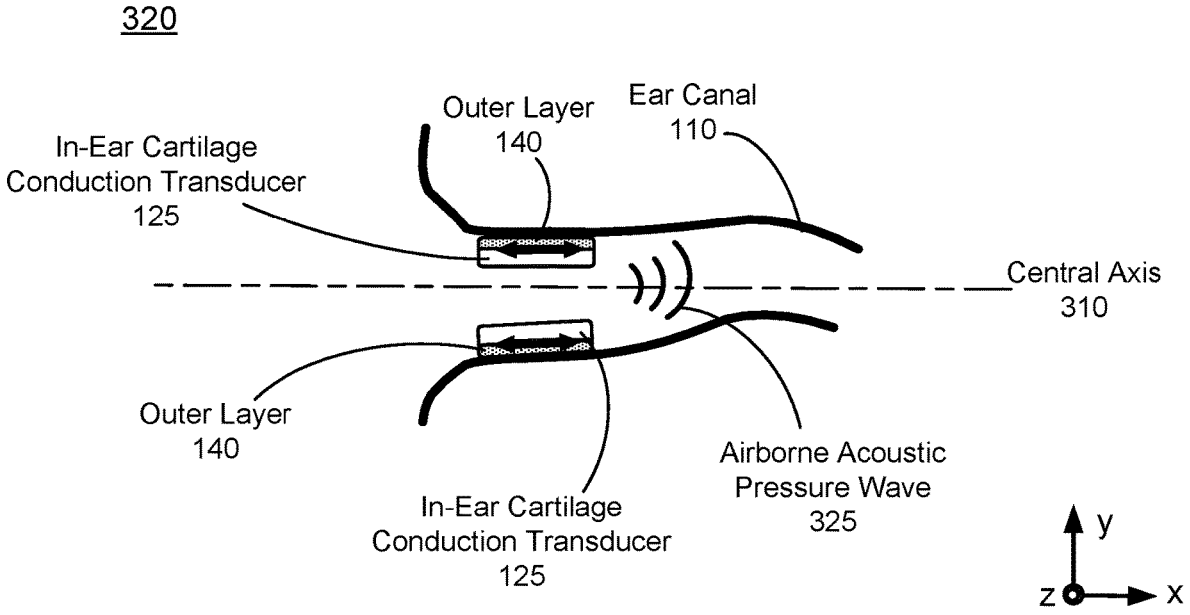
FIG. 3B is a cross-sectional view of an in-ear cartilage conduction transducer assembly operating in a transversal vibration mode, in accordance with one or more embodiments.

FIG. 3B is a cross-sectional view 320 of the in-ear cartilage conduction transducer 125 operating in a transversal vibration mode, in accordance with one or more embodiments. The in-ear cartilage conduction transducer 125 may vibrate, via the outer layer 140, a tissue of the ear canal 110 in a transversal direction (e.g., parallel with a x dimension in FIG. 3B) for creating an airborne acoustic pressure wave 325 within the ear canal 110. The transverse direction can be defined as a direction parallel to the central axis 310 of the ear canal 110.

Figure 4:
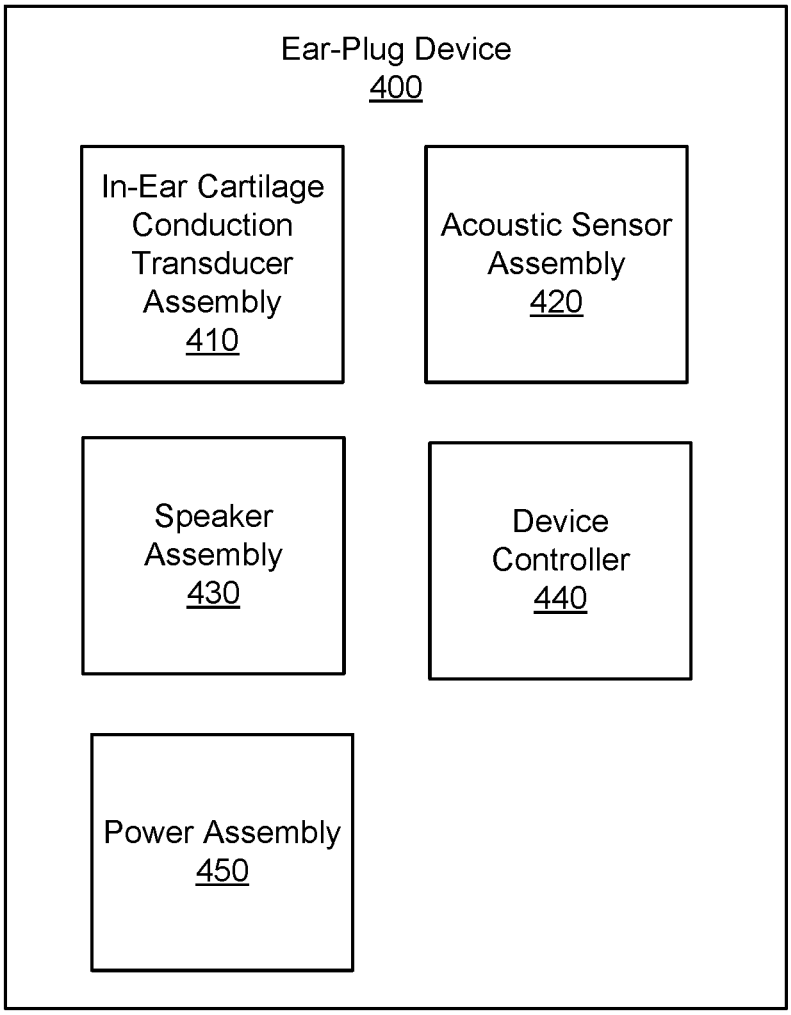
FIG. 4 is a block diagram of an ear-plug device, in accordance with one or more embodiments.

FIG. 4 is a block diagram of an ear-plug device 400, in accordance with one or more embodiments. The ear-plug device 400 may be a component of an audio system that provides audio content to a user (e.g., as discussed below with regard to FIG. 7). The ear-plug device includes an in-ear cartilage conduction transducer assembly 410, an acoustic sensor assembly 420, a speaker assembly 430, a device controller 440, and a power assembly 450. The ear-plug devices described in previous figures (e.g., the ear-plug device 105, the ear-plug device 205) are embodiments of the ear-plug device 400. Some embodiments of the ear-plug device 400 include other components than those described herein.

The in-ear cartilage conduction transducer assembly 410 is located in an ear canal of a user and vibrates a portion of the ear canal to cause the ear canal to create an airborne acoustic pressure wave in the ear canal in accordance with vibration instructions. The airborne acoustic pressure wave corresponds to and is for presentation of audio content to the user. The in-ear cartilage conduction transducer assembly 410 includes at least one cartilage conduction transducer that generates airborne acoustic pressure waves by vibrating a tissue of the canal. The generated airborne acoustic pressure waves propagate down the ear canal toward an eardrum.

The in-ear cartilage conduction transducer assembly 410 generates content in accordance with the vibration instructions from the device controller 440. In some embodiments, the content is spatialized. Spatialized content is content that appears to originate from a particular direction and/or target region (e.g., an object in the local area and/or a virtual object). For example, spatialized content can make it appear that sound is originating from a virtual singer across a room from a user of the ear-plug device 400.

In one embodiment, the in-ear cartilage conduction transducer assembly 410 vibrates the ear canal in a radial direction for creating the airborne acoustic pressure wave, the radial direction pointing along one or more radii orthogonal to a central axis of the ear canal. In another embodiment, the in-ear cartilage conduction transducer assembly 410 vibrates the ear canal in a transverse direction pointing parallel to a central axis of the ear canal for creating the airborne acoustic pressure wave.

In one or more embodiments, the in-ear cartilage conduction transducer assembly 410 includes an outer surface that has a radius of curvature such that the in-ear cartilage conduction transducer assembly 410 fits within the ear canal. The in-ear cartilage conduction transducer assembly 410 may further include an outer layer connected to a cartilage conduction transducer. The outer layer couples the ear-plug device 400 to the ear canal. Further, the outer layer reduces an impedance mismatch between the cartilage conduction transducer and a tissue of the ear canal below a threshold level.

In one embodiment, the in-ear cartilage conduction transducer assembly 410 includes a piezoelectric transducer. In another embodiment, the in-ear cartilage conduction transducer assembly 410 includes a moving coil transducer. In yet another embodiment, the in-ear cartilage conduction transducer assembly 410 includes an electrostatic transducer. In some embodiments, the in-ear cartilage conduction transducer assembly 410 may include one or more cartilage conduction transducers to cover different parts of a frequency range. For example, a piezoelectric transducer may be used to cover a first part of a frequency range and a moving coil transducer may be used to cover a second part of a frequency range.

The acoustic sensor assembly 420 detects sound. The acoustic sensor assembly 420 may include one or more acoustic sensors, which may be microphones, accelerometers, another sensor that detects acoustic pressure waves, or some combination thereof. An outer acoustic sensor (e.g., microphone) of the acoustic sensor assembly 420, positioned in a portion of the ear-plug device 400 outside an ear canal of the user, may detect sound from a local area around the user. An inner acoustic sensor (e.g., microphone) of the acoustic sensor assembly 420, positioned in a portion of the ear-plug device 400 that fits within the ear canal of the user, may detect sound presented to the user by tissue conduction, e.g., by the in-ear cartilage conduction transducer assembly 410. The acoustic sensors are configured to detect acoustic pressure waves and convert the detected pressure waves into an electric format (analog or digital).

The speaker assembly 430 presents audio content to the user in accordance with instructions from the device controller 440. The speaker assembly 430 presents audio content to an ear canal of the user, based in part on sounds detected by the acoustic sensor assembly 420. The detected sound may be filtered, augmented, amplified, or attenuated when presented by the speaker assembly 430. In some embodiments, the speaker assembly 430 generates one or more airborne acoustic pressure waves in the ear canal to attenuate the sounds (e.g., noise) from the local area propagating through a waveguide of the ear-plug device 400 into the ear canal. The speaker assembly 430 may be composed of one or more speakers, such as the speaker 145 in FIG. 1 and/or the speaker 225 in FIG. 2, and present sound via airborne acoustic pressure waves. The speaker assembly 430 may be configured to present audio content over a range of frequencies, such as 20 Hz to 20 kHz, generally around the average range of human hearing.

The device controller 440 may control operations of the in-ear cartilage conduction transducer assembly 410. The device controller 440 may also control operations of the speaker assembly 430. The device controller 440 may instruct the in-ear cartilage conduction transducer assembly 410 to vibrate a portion of the ear canal to cause the ear canal to create an airborne acoustic pressure wave in the ear canal in accordance with vibration instructions, and the airborne acoustic pressure wave corresponds to and is for presentation of audio content to the user.

Acoustic pressure wave (sound) data may be detected by the acoustic sensor assembly 420 and subsequently sent to the device controller 440. The sound data may include sounds from a local area outside an ear canal detected by, e.g., an external microphone of the acoustic sensor assembly 420, sounds from the ear canal detected by, e.g., an internal microphone of the acoustic sensor assembly 420 positioned in the ear canal, or combination thereof. The device controller 440 processes the sound data and instructs the in-ear cartilage conduction transducer assembly 410 and/or the speaker assembly 430 to present audio content based at least in part on the sound data.

In an embodiment, the device controller 440 may update the vibration instructions based at least in part on the sound data, and provide the updated vibration instructions to the in-ear cartilage conduction transducer assembly 410. In one or more other embodiments, the device controller 440 may control, based on the sound data, a controllable block of the ear-plug device 400 to attenuate sounds from the local area propagating into the ear canal, wherein an amount of attenuation is based on a state of the controllable block controlled by the device controller 440. In an embodiment, the controllable block is a mechanical shutter, and the device controller 440 controls (e.g., via one or more mechanical actuators attached to the mechanical shutter) a state of the mechanical shutter (e.g., open, closed, partially open) for controlling an opening of a waveguide of the ear-plug device 400 which controls a level of attenuation of sounds from the local area that propagate into the ear canal. In another embodiment, the controllable block is the speaker assembly 430, and the device controller 440 instructs the speaker assembly 430 (e.g., via the vibration instructions) to generate one or more airborne acoustic pressure waves in the ear canal to attenuate the sounds from the local area propagating into the ear canal. By controlling the controllable block, the device controller 440 may switch the ear-plug device 400 from an-open ear device configuration to a closed-ear device configuration, and vice versa.

Vibration instructions of the device controller 440 for the speaker assembly 430 may include instructions to present filtered sound from the local area. For example, the device controller 440 may generate sound filters that target a specific range of frequencies. The sound at these frequencies may be amplified, attenuated, or augmented, wherein the speaker assembly 430 presents audio content accordingly. Examples of sound filters include, among others, low pass filters, high pass filters, and bandpass filters. In some embodiments, certain frequency ranges may be amplified, preserving spatial cues and helping users with hearing loss in those frequency ranges better hear their environment.

In other embodiments, the device controller 440 may filter out noise generated by acoustic sensors in the acoustic sensor assembly 420. Since the acoustic sensors are small in size, the acoustic sensors are more likely to produce noise. In some embodiments, the user's voice may be amplified due to occlusion of the ear canal by the ear-plug device 400. The device controller 440 may attenuate the amplitude of the user's voice, such that the user is able to hear the audio content presented by the in-ear cartilage conduction transducer assembly 410.

The power assembly 450 provides the ear-plug device 400 with power. In some embodiments, there are one or more power units for some or all of the components of the ear-plug device 400. The power assembly 450 may provide power to, e.g., some or all of the components of the in-ear cartilage conduction transducer assembly 410, the acoustic sensor assembly 420, and the speaker assembly 430. A power unit is a battery. In some cases, a power unit is a rechargeable battery. In some embodiments, the power unit may be powered wirelessly (for example, inductively). In these embodiments, the power assembly 450 may include one or more receiving coils to receive power.

The ear-plug device 400 may be used to provide audio content to the user. In some embodiments, the ear-plug device 400 may work in conjunction with an artificial reality headset, such as those described by FIGS. 6A-6B. For example, the ear-plug device 400 may be used as an integral part of an audio system of the artificial reality headset.

Figure 5:
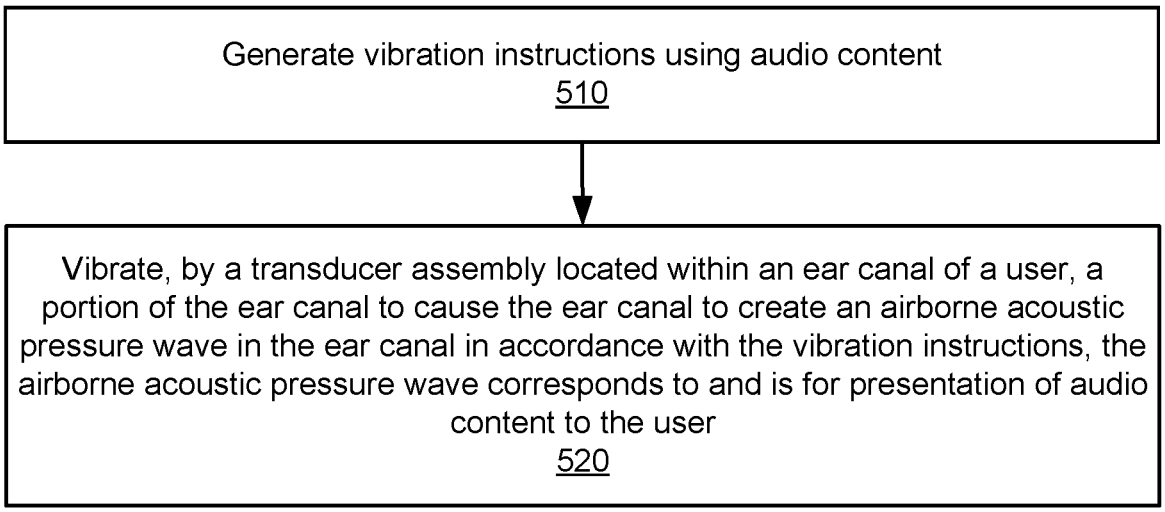
FIG. 5 is a flowchart illustrating a process for presenting audio content to a user using an in-ear cartilage conduction transducer assembly, in accordance with one or more embodiments.

FIG. 5 is a flowchart of a method 500 for presenting audio content to a user using an ear-plug device, in accordance with one or more embodiments. The process shown in FIG. 5 may be performed by components of an ear-plug device (e.g., the ear-plug device 400). Other entities may perform some or all of the steps in FIG. 5 in other embodiments. Embodiments may include different and/or additional steps, or perform the steps in different orders. The audio system may be part of a headset.

The ear-plug device generates 510 (e.g., via the device controller 430) vibration instructions using audio content, such as a music, a voice from phone call (e.g., the ear-plug device hooked up to a cell phone), etc. The generated vibration instructions are provided to a transducer assembly located within an ear canal of a user, e.g., the in-ear cartilage conduction transducer assembly 410. In an embodiment, the vibration instructions are generated by a controller integrated into a peripheral device, e.g., a headset, a mobile device, a console, etc.

The ear-plug device vibrates 520 (e.g., via the in-ear cartilage conduction transducer assembly 410), a portion of the ear canal of the user to cause the ear canal to create an airborne acoustic pressure wave in the ear canal in accordance with the vibration instructions, the airborne acoustic pressure wave corresponds to and is for presentation of audio content to the user. In one embodiment, the ear-plug device vibrates the ear canal in at least one radial direction for creating the airborne acoustic pressure wave. In another embodiment, the ear-plug device vibrates the ear canal in at least one transverse direction for creating the airborne acoustic pressure wave.

Figure 6A:
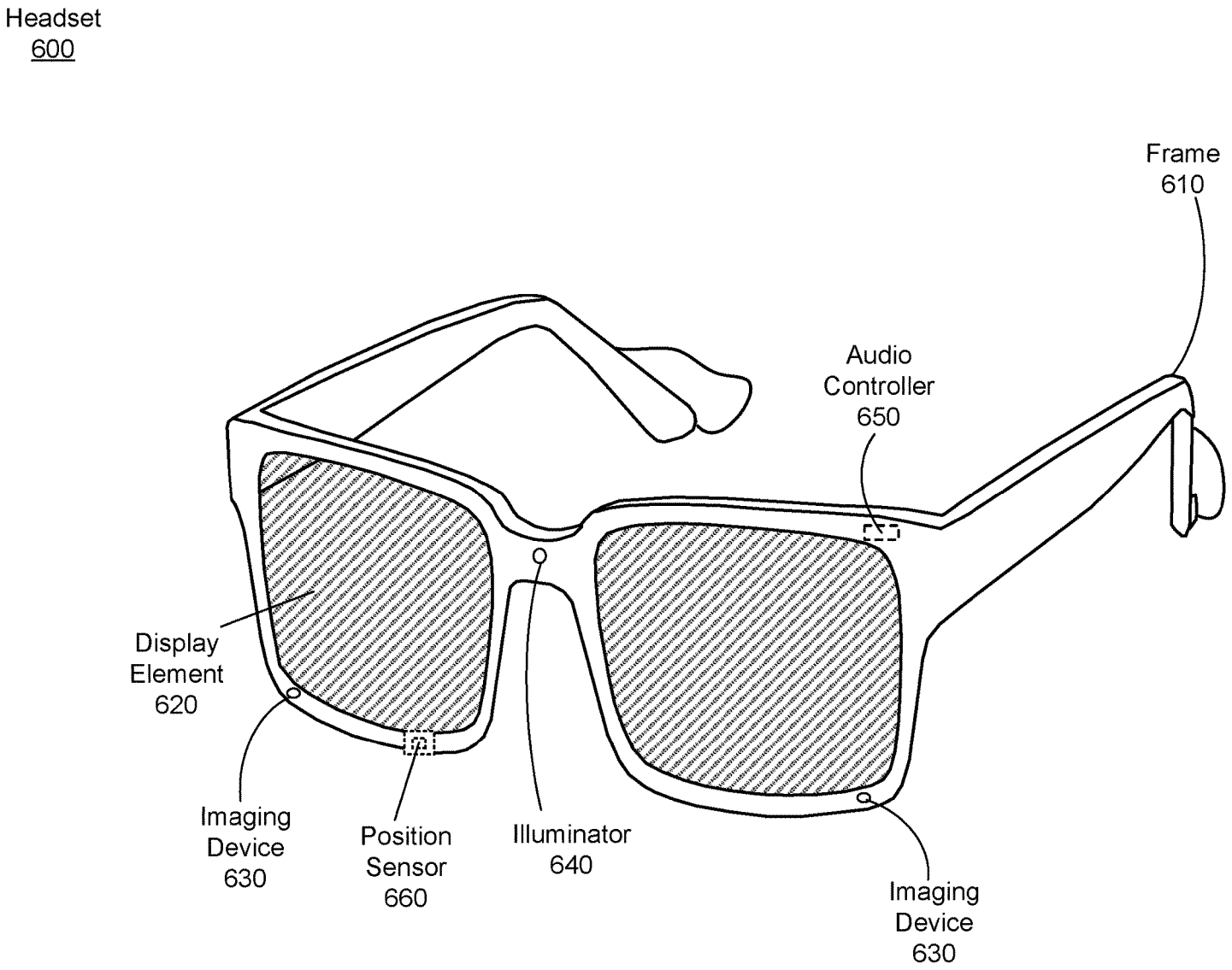
FIG. 6A is a perspective view of a headset implemented as an eyewear device, in accordance with one or more embodiments.

FIG. 6A is a perspective view of a headset 600 implemented as an eyewear device, in accordance with one or more embodiments. In some embodiments, the eyewear device is a near eye display (NED). In general, the headset 600 may be worn on the face of a user such that content (e.g., media content) is presented using a display assembly and/or an audio system. However, the headset 600 may also be used such that media content is presented to a user in a different manner. Examples of media content presented by the headset 600 include one or more images, video, audio, or some combination thereof. The headset 600 includes a frame 610, and may include, among other components, a display assembly including one or more display elements 620, a depth camera assembly (DCA), an audio system, and a position sensor 660. While FIG. 6A illustrates the components of the headset 600 in example locations on the headset 600, the components may be located elsewhere on the headset 600, on a peripheral device paired with the headset 600, or some combination thereof. Similarly, there may be more or fewer components on the headset 600 than what is shown in FIG. 6A. The headset 600 is suitable to work together with ear-plug devices, such as the ear-plug device 105 and/or the ear-plug device 400 to provide audio content to the user.

The frame 610 holds the other components of the headset 600. The frame 610 includes a front part that holds the one or more display elements 620 and end pieces (e.g., temples) to attach to a head of the user. The front part of the frame 610 bridges the top of a nose of the user. The length of the end pieces may be adjustable (e.g., adjustable temple length) to fit different users. The end pieces may also include a portion that curls behind the ear of the user (e.g., temple tip, ear piece).

The one or more display elements 620 provide light to a user wearing the headset 600. As illustrated the headset includes a display element 620 for each eye of a user. In some embodiments, a display element 620 generates image light that is provided to an eyebox of the headset 600. The eyebox is a location in space that an eye of user occupies while wearing the headset 600. For example, a display element 620 may be a waveguide display. A waveguide display includes a light source (e.g., a two-dimensional source, one or more line sources, one or more point sources, etc.) and one or more waveguides. Light from the light source is in-coupled into the one or more waveguides which outputs the light in a manner such that there is pupil replication in an eyebox of the headset 600. In-coupling and/or outcoupling of light from the one or more waveguides may be done using one or more diffraction gratings. In some embodiments, the waveguide display includes a scanning element (e.g., waveguide, mirror, etc.) that scans light from the light source as it is in-coupled into the one or more waveguides. Note that in some embodiments, one or both of the display elements 620 are opaque and do not transmit light from a local area around the headset 600. The local area is the area surrounding the headset 600. For example, the local area may be a room that a user wearing the headset 600 is inside, or the user wearing the headset 600 may be outside and the local area is an outside area. In this context, the headset 600 generates VR content. Alternatively, in some embodiments, one or both of the display elements 620 are at least partially transparent, such that light from the local area may be combined with light from the one or more display elements to produce AR and/or MR content. In some embodiments, a display element 620 does not generate image light, and instead is a lens that transmits light from the local area to the eyebox. For example, one or both of the display elements 620 may be a lens without correction (non-prescription) or a prescription lens (e.g., single vision, bifocal and trifocal, or progressive) to help correct for defects in a user's eyesight. In some embodiments, the display element 620 may be polarized and/or tinted to protect the user's eyes from the sun.

Note that in some embodiments, the display element 620 may include an additional optics block (not shown). The optics block may include one or more optical elements (e.g., lens, Fresnel lens, etc.) that direct light from the display element 620 to the eyebox. The optics block may, e.g., correct for aberrations in some or all of the image content, magnify some or all of the image, or some combination thereof.

The DCA determines depth information for a portion of a local area surrounding the headset 600. The DCA includes one or more imaging devices 630 and a DCA controller (not shown in FIG. 4A), and may also include an illuminator 640. In some embodiments, the illuminator 640 illuminates a portion of the local area with light. The light may be, e.g., structured light (e.g., dot pattern, bars, etc.) in the infrared (IR), IR flash for time-of-flight, etc. In some embodiments, the one or more imaging devices 630 capture images of the portion of the local area that include the light from the illuminator 640. As illustrated, FIG. 6A shows a single illuminator 640 and two imaging devices 630. In alternate embodiments, there is no illuminator 640 and at least two imaging devices 630.

The DCA controller computes depth information for the portion of the local area using the captured images and one or more depth determination techniques. The depth determination technique may be, e.g., direct time-of-flight (ToF) depth sensing, indirect ToF depth sensing, structured light, passive stereo analysis, active stereo analysis (uses texture added to the scene by light from the illuminator 640), some other technique to determine depth of a scene, or some combination thereof.

The audio system provides audio content. The audio system includes a transducer array, a sensor array, and an audio controller 650. However, in other embodiments, the audio system may include different and/or additional components. Similarly, in some cases, functionality described with reference to the components of the audio system can be distributed among the components in a different manner than is described here. For example, some or all of the functions of the controller may be performed by a remote server.

The audio controller 650 processes information from the sensor array that describes sounds detected by the sensor array. The audio controller 650 may comprise a processor and a computer-readable storage medium. The audio controller 650 may be configured to generate direction of arrival (DOA) estimates, generate acoustic transfer functions (e.g., array transfer functions and/or head-related transfer functions), track the location of sound sources, form beams in the direction of sound sources, classify sound sources, generate sound filters for the speakers 460, or some combination thereof.

The position sensor 660 generates one or more measurement signals in response to motion of the headset 600. The position sensor 660 may be located on a portion of the frame 610 of the headset 600. The position sensor 660 may include an inertial measurement unit (IMU). Examples of position sensor 660 include: one or more accelerometers, one or more gyroscopes, one or more magnetometers, another suitable type of sensor that detects motion, a type of sensor used for error correction of the IMU, or some combination thereof. The position sensor 490 may be located external to the IMU, internal to the IMU, or some combination thereof.

In some embodiments, the headset 600 may provide for simultaneous localization and mapping (SLAM) for a position of the headset 600 and updating of a model of the local area. For example, the headset 600 may include a passive camera assembly (PCA) that generates color image data. The PCA may include one or more RGB cameras that capture images of some or all of the local area. In some embodiments, some or all of the imaging devices 430 of the DCA may also function as the PCA. The images captured by the PCA and the depth information determined by the DCA may be used to determine parameters of the local area, generate a model of the local area, update a model of the local area, or some combination thereof. Furthermore, the position sensor 660 tracks the position (e.g., location and pose) of the headset 600 within the room.

Figure 6B:
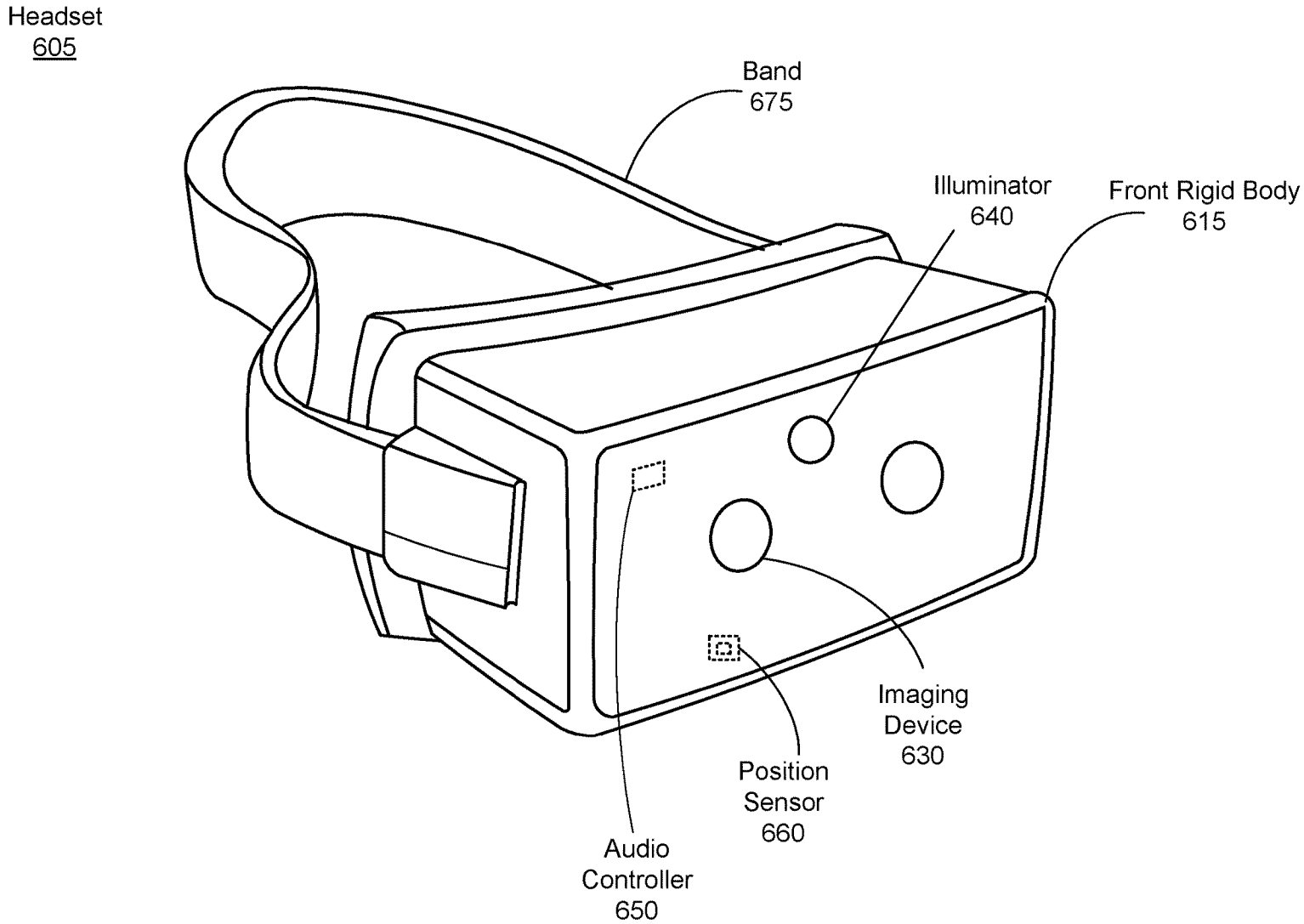
FIG. 6B is a perspective view of a headset implemented as a head-mounted display, in accordance with one or more embodiments.

FIG. 6B is a perspective view of a headset 605 implemented as a HMD, in accordance with one or more embodiments. In embodiments that describe an AR system and/or a MR system, portions of a front side of the HMD are at least partially transparent in the visible band (~380 nm to 750 nm), and portions of the HMD that are between the front side of the HMD and an eye of the user are at least partially transparent (e.g., a partially transparent electronic display). The HMD includes a front rigid body 615 and a band 675. The headset 605 includes many of the same components described above with reference to FIG. 6A, but modified to integrate with the HMD form factor. For example, the HMD includes a display assembly, a DCA, an audio system, and a position sensor 660. FIG. 6B shows the illuminator 640, a plurality of the imaging devices 630, the audio controller 650, and the position sensor 660.

An ear-plug device, such as the ear-plug device 400, may work in conjunction with the headset 600 and/or the headset 605. In some embodiments, some components of the headset 600 and/or the headset 605 may double as components of the ear-plug device 400. For example, the audio controller 650 may serve as the device controller 430 of the ear-plug device 400. In some embodiments, the user may wear the headset 600 and/or the headset 605 in addition to the ear-plug device 400. In another embodiment, the headset 600 and/or 605 may present visual content to the user, via the display element 620, that corresponds to audio content presented by the ear-plug device 400.

Example of an Artificial Reality System

Figure 7:
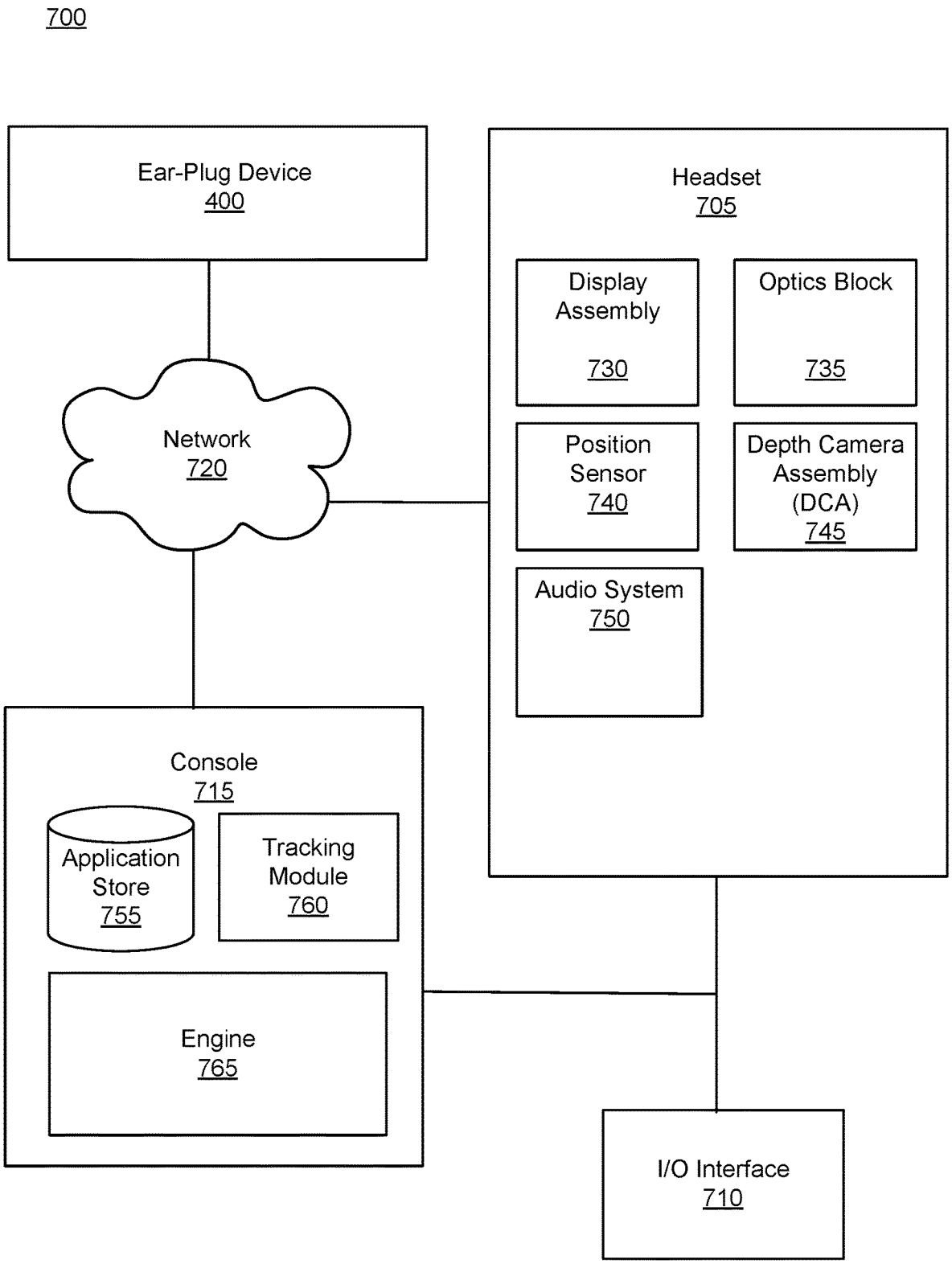
FIG. 7 is a block diagram of an example artificial reality system environment, including an ear-plug device, in accordance with one or more embodiments.

FIG. 7 is a system 700 that includes a headset 705, in accordance with one or more embodiments. In some embodiments, the headset 705 may be the headset 600 of FIG. 6A or the headset 605 of FIG. 6B. The system 700 may operate in an artificial reality environment (e.g., a virtual reality environment, an augmented reality environment, a mixed reality environment, or some combination thereof). The system 700 shown by FIG. 7 includes the headset 705, an input/output (I/O) interface 710 that is coupled to a console 715, a network 720, and the ear-plug device 400. While FIG. 7 shows an example system 700 including one headset 705 and one I/O interface 710, in other embodiments any number of these components may be included in the system 700. For example, there may be multiple headsets each having an associated I/O interface 710, with each headset and I/O interface 710 communicating with the console 715. In alternative configurations, different and/or additional components may be included in the system 700. Additionally, functionality described in conjunction with one or more of the components shown in FIG. 7 may be distributed among the components in a different manner than described in conjunction with FIG. 7 in some embodiments. For example, some or all of the functionality of the console 715 may be provided by the headset 705.

The headset 705 includes the display assembly 730, an optics block 735, one or more position sensors 740, and the DCA 745. Some embodiments of headset 705 have different components than those described in conjunction with FIG. 7. Additionally, the functionality provided by various components described in conjunction with FIG. 7 may be differently distributed among the components of the headset 705 in other embodiments, or be captured in separate assemblies remote from the headset 705.

The network 720 connects the headset 705 to the ear-plug device 400. The network 720 may include any combination of local area and/or wide area networks using both wireless and/or wired communication systems. For example, the network 720 may include the Internet, as well as mobile telephone networks. In one embodiment, the network 720 uses standard communications technologies and/or protocols. Hence, the network 720 may include links using technologies such as Ethernet, 802.11, worldwide interoperability for microwave access (WiMAX), 2G/3G/4G mobile communications protocols, digital subscriber line (DSL), asynchronous transfer mode (ATM), InfiniBand, PCI Express Advanced Switching, Bluetooth, etc. Similarly, the networking protocols used on the network 720 can include multiprotocol label switching (MPLS), the transmission control protocol/Internet protocol (TCP/IP), the User Datagram Protocol (UDP), the hypertext transport protocol (HTTP), the simple mail transfer protocol (SMTP), the file transfer protocol (FTP), etc. The data exchanged over the network 720 can be represented using technologies and/or formats including image data in binary form (e.g. Portable Network Graphics (PNG)), hypertext markup language (HTML), extensible markup language (XML), etc. In addition, all or some of links can be encrypted using conventional encryption technologies such as secure sockets layer (SSL), transport layer security (TLS), virtual private networks (VPNs), Internet Protocol security (IPsec), etc. The network 720 may also connect multiple headsets located in the same or different physical locations to the ear-plug device 400.

The display assembly 730 displays content to the user in accordance with data received from the console 715. The display assembly 730 displays the content using one or more display elements (e.g., the display elements 620). A display element may be, e.g., an electronic display. In various embodiments, the display assembly 730 comprises a single display element or multiple display elements (e.g., a display for each eye of a user). Examples of an electronic display include: a liquid crystal display (LCD), an organic light emitting diode (OLED) display, an active-matrix organic light-emitting diode display (AMOLED), a waveguide display, some other display, or some combination thereof. In some embodiments, the display assembly 730 may also include some or all of the functionality of the optics block 735.

The optics block 735 may magnify image light received from the electronic display, corrects optical errors associated with the image light, and presents the corrected image light to one or both eyeboxes of the headset 705. In various embodiments, the optics block 735 includes one or more optical elements. Example optical elements included in the optics block 735 include: an aperture, a Fresnel lens, a convex lens, a concave lens, a filter, a reflecting surface, or any other suitable optical element that affects image light. Moreover, the optics block 735 may include combinations of different optical elements. In some embodiments, one or more of the optical elements in the optics block 735 may have one or more coatings, such as partially reflective or anti-reflective coatings.

Magnification and focusing of the image light by the optics block 735 allows the electronic display to be physically smaller, weigh less, and consume less power than larger displays. Additionally, magnification may increase the field of view of the content presented by the electronic display. For example, the field of view of the displayed content is such that the displayed content is presented using almost all (e.g., approximately 110 degrees diagonal), and in some cases all, of the user's field of view. Additionally, in some embodiments, the amount of magnification may be adjusted by adding or removing optical elements.

In some embodiments, the optics block 735 may be designed to correct one or more types of optical error. Examples of optical error include barrel or pincushion distortion, longitudinal chromatic aberrations, or transverse chromatic aberrations. Other types of optical errors may further include spherical aberrations, chromatic aberrations, or errors due to the lens field curvature, astigmatisms, or any other type of optical error. In some embodiments, content provided to the electronic display for display is pre-distorted, and the optics block 735 corrects the distortion when it receives image light from the electronic display generated based on the content.

The position sensor 740 is an electronic device that generates data indicating a position of the headset 705. The position sensor 740 generates one or more measurement signals in response to motion of the headset 705. The position sensor 740 is an embodiment of the position sensor 660. Examples of a position sensor 740 include: one or more IMUS, one or more accelerometers, one or more gyroscopes, one or more magnetometers, another suitable type of sensor that detects motion, or some combination thereof. The position sensor 740 may include multiple accelerometers to measure translational motion (forward/back, up/down, left/right) and multiple gyroscopes to measure rotational motion (e.g., pitch, yaw, roll). In some embodiments, an IMU rapidly samples the measurement signals and calculates the estimated position of the headset 705 from the sampled data. For example, the IMU integrates the measurement signals received from the accelerometers over time to estimate a velocity vector and integrates the velocity vector over time to determine an estimated position of a reference point on the headset 705. The reference point is a point that may be used to describe the position of the headset 705. While the reference point may generally be defined as a point in space, however, in practice the reference point is defined as a point within the headset 705.

The DCA 745 generates depth information for a portion of the local area. The DCA includes one or more imaging devices and a DCA controller. The DCA 745 may also include an illuminator. Operation and structure of the DCA 745 is described above with regard to FIG. 6A.

The audio system 750 provides audio content to a user of the headset 705. The audio system 750 may comprise one or acoustic sensors, one or more transducers, and an audio controller. The audio system 750 may provide spatialized audio content to the user. In some embodiments, the audio system 750 may request acoustic parameters from a mapping server, e.g., over the network 720. The acoustic parameters describe one or more acoustic properties (e.g., room impulse response, a reverberation time, a reverberation level, etc.) of the local area. The audio system 750 may provide information describing at least a portion of the local area from e.g., the DCA 745 and/or location information for the headset 705 from the position sensor 740. The audio system 750 may generate one or more sound filters using one or more of the acoustic parameters received from the mapping server, and use the sound filters to provide audio content to the user.

The audio system 750 also presents audio content to the user of the headset 705. In some embodiments, the ear-plug device 400 may be a component of the audio system 750. In some embodiments, the audio system 750 may use the ear-plug device 400 for calibration. The audio system 750 may present to the user audio content via air conduction and/or tissue conduction. In tissue conduction, the tissue in and/or around the user's ear is vibrated to produce acoustic pressure waves perceived by a cochlea of the user's ear as sound.

The I/O interface 710 is a device that allows a user to send action requests and receive responses from the console 715. An action request is a request to perform a particular action. For example, an action request may be an instruction to start or end capture of image or video data, or an instruction to perform a particular action within an application. The I/O interface 710 may include one or more input devices. Example input devices include: a keyboard, a mouse, a game controller, or any other suitable device for receiving action requests and communicating the action requests to the console 715. An action request received by the I/O interface 710 is communicated to the console 715, which performs an action corresponding to the action request. In some embodiments, the I/O interface 710 includes an IMU that captures calibration data indicating an estimated position of the I/O interface 710 relative to an initial position of the I/O interface 710. In some embodiments, the I/O interface 710 may provide haptic feedback to the user in accordance with instructions received from the console 715. For example, haptic feedback is provided when an action request is received, or the console 715 communicates instructions to the I/O interface 710 causing the I/O interface 710 to generate haptic feedback when the console 715 performs an action.

The console 715 provides content to the headset 705 for processing in accordance with information received from one or more of: the DCA 745, the headset 705, and the I/O interface 710. In the example shown in FIG. 7, the console 715 includes an application store 755, a tracking module 760, and an engine 765. Some embodiments of the console 715 have different modules or components than those described in conjunction with FIG. 7. Similarly, the functions further described below may be distributed among components of the console 715 in a different manner than described in conjunction with FIG. 7. In some embodiments, the functionality discussed herein with respect to the console 715 may be implemented in the headset 705, or a remote system.

The application store 755 stores one or more applications for execution by the console 715. An application is a group of instructions, that when executed by a processor, generates content for presentation to the user. Content generated by an application may be in response to inputs received from the user via movement of the headset 705 or the I/O interface 710. Examples of applications include: gaming applications, conferencing applications, video playback applications, or other suitable applications.

The tracking module 760 tracks movements of the headset 705 or of the I/O interface 710 using information from the DCA 745, the one or more position sensors 740, or some combination thereof. For example, the tracking module 760 determines a position of a reference point of the headset 705 in a mapping of a local area based on information from the headset 705. The tracking module 760 may also determine positions of an object or virtual object. Additionally, in some embodiments, the tracking module 760 may use portions of data indicating a position of the headset 705 from the position sensor 740 as well as representations of the local area from the DCA 745 to predict a future location of the headset 705. The tracking module 760 provides the estimated or predicted future position of the headset 705 or the I/O interface 710 to the engine 765.

The engine 765 executes applications and receives position information, acceleration information, velocity information, predicted future positions, or some combination thereof, of the headset 705 from the tracking module 760. Based on the received information, the engine 765 determines content to provide to the headset 705 for presentation to the user. For example, if the received information indicates that the user has looked to the left, the engine 765 generates content for the headset 505 that mirrors the user's movement in a virtual local area or in a local area augmenting the local area with additional content. Additionally, the engine 765 performs an action within an application executing on the console 715 in response to an action request received from the I/O interface 710 and provides feedback to the user that the action was performed. The provided feedback may be visual or audible feedback via the headset 505 or haptic feedback via the I/O interface 710.

The ear-plug device 400 provides audio content to the user. The ear-plug device 400, as described with respect to FIGS. 1-4, includes the transducer assembly 410 having at least one transducer (e.g., the transducer 125) located within an ear canal of the user. The transducer 125 vibrates a portion of the ear canal to cause the ear canal to create an airborne acoustic pressure wave in the ear canal in accordance with vibration instructions, the airborne acoustic pressure wave corresponds to and is for presentation of the audio content to the user. The ear-plug device 400 is powered by the power assembly 450. The ear-plug device 400 may be used alone and/or in combination with the audio system 750, providing audio content to the user of the headset 505. In some embodiments, the user may use two ear-plug devices 400, i.e., one for each ear. Each ear-plug device 400 may provide a portion of the audio content as instructed by the device controller 440.

Additional Configuration Information

The foregoing description of the embodiments has been presented for illustration; it is not intended to be exhaustive or to limit the patent rights to the precise forms disclosed. Persons skilled in the relevant art can appreciate that many modifications and variations are possible considering the above disclosure.

Some portions of this description describe the embodiments in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all the steps, operations, or processes described.

Embodiments may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the patent rights. It is therefore intended that the scope of the patent rights be limited not by this detailed description, but rather by any claims that issue on an application based hereon. Accordingly, the disclosure of the embodiments is intended to be illustrative, but not limiting, of the scope of the patent rights, which is set forth in the following claims.

What is claimed is:

1. An ear-plug device comprising:

a body configured to at least partially fit inside an ear canal of a user; and a transducer assembly coupled to the body, the transducer assembly including:

at least one transducer located within the ear canal, the at least one transducer configured to vibrate a portion of the ear canal to cause the ear canal to create an airborne acoustic pressure wave in the ear canal in accordance with vibration instructions, wherein the airborne acoustic pressure wave corresponds to and is for presentation of audio content to the user, and at least one acoustic sensor located within the ear canal, the at least one acoustic sensor configured to collect sounds from within the ear canal, the vibration instructions being updated based at least in part on the collected sounds.

2. The ear-plug device of claim 1, wherein the at least one transducer is configured to vibrate the ear canal in a radial direction for creating the airborne acoustic pressure wave, the radial direction pointing along one or more radii orthogonal to a central axis of the ear canal.

3. The ear-plug device of claim 1, wherein the at least one transducer is configured to vibrate the ear canal in a transverse direction parallel to a central axis of the ear canal for creating the airborne acoustic pressure wave.

4. The ear-plug device of claim 1, wherein the at least one transducer includes an outer surface that has a radius of curvature such that the at least one transducer fits within the ear canal.

5. The ear-plug device of claim 1, wherein the transducer assembly further includes an outer layer connected to the at least one transducer, the outer layer configured to:

couple the at least one transducer to the ear canal, and reduce an impedance mismatch between the at least one transducer and a tissue of the ear canal below a threshold level.

6. The ear-plug device of claim 1, wherein the ear-plug device further includes a waveguide through which sounds from a local area outside of the ear canal propagate into the ear canal.

7. The ear-plug device of claim 1, further comprising:

a waveguide through which sounds from a local area outside of the ear canal propagate into the ear canal; and a controllable block configured to attenuate the sounds from the local area propagating through the waveguide into the ear canal, wherein an amount of attenuation is based on a state of the controllable block.

8. The ear-plug device of claim 7, wherein the controllable block is a mechanical shutter that obstructs the waveguide, and the amount of obstruction is based on the state of the controllable block.

9. The ear-plug device of claim 7, wherein the controllable block includes one or more air conduction transducers located within the ear canal, the one or more air conduction transducers configured to generate one or more airborne acoustic pressure waves in the ear canal to attenuate the sounds from the local area propagating through the waveguide into the ear canal.

10. The ear-plug device of claim 1, wherein the ear-plug device further includes at least one microphone positioned externally from the ear canal configured to detect sounds from a local area outside of the ear canal, the vibration instructions being updated based at least in part on the detected sounds from the local area.

11. The ear-plug device of claim 10, wherein the at least one microphone is positioned at an entrance to the ear canal.

12. The ear-plug device of claim 10, wherein the at least one microphone is positioned to detect a speech of the user.

13. The ear-plug device of claim 1, wherein the at least one acoustic sensor includes at least one microphone positioned inside the ear canal configured to collect portions of the sounds from within the ear canal generated by the at least one transducer, the vibration instructions being updated based at least in part on the collected portions of the sounds.

14. The ear-plug device of claim 1, wherein the at least one transducer is a piezoelectric transducer.

15. The ear-plug device of claim 1, wherein a controller integrated into a peripheral device is configured to generate the vibration instructions for the transducer assembly.

16. The ear-plug device of claim 15, wherein the peripheral device is a headset.

17. A method comprising:

generating vibration instructions using audio content;

vibrating, by at least one transducer of a transducer assembly located within an ear canal of a user, a portion of the ear canal to cause the ear canal to create an airborne acoustic pressure wave in the ear canal in accordance with the vibration instructions, wherein the airborne acoustic pressure wave corresponds to and is for presentation of audio content to the user;

collecting, by at least one acoustic sensor of the transducer assembly located within the ear canal, sounds from within the ear canal; and updating the vibration instructions based at least in part on the collected sounds.

18. The method of claim 17, further comprising:

vibrating, by the at least one transducer, the ear canal in a radial direction for creating the airborne acoustic pressure wave, the radial direction pointing along one or more radii orthogonal to a central axis of the ear canal.

19. An audio system comprising:

an ear-plug device including:

a body configured to at least partially fit inside an ear canal of a user, and a transducer assembly coupled to the body, the transducer assembly including:

at least one transducer located within the ear canal, the at least one transducer configured to vibrate a portion of the ear canal to cause the ear canal to create an airborne acoustic pressure wave in the ear canal in accordance with vibration instructions, wherein the airborne acoustic pressure wave corresponds to and is for presentation of audio content to the user, and at least one acoustic sensor located within the ear canal, the at least one acoustic sensor configured to collect sounds from within the ear canal, the vibration instructions being updated based at least in part on the collected sounds; and a controller configured to provide the vibration instructions to the transducer assembly for presenting the audio content to the user.

20. The audio system of claim 19, wherein the controller is integrated into a peripheral device separate from the ear-plug device.

* * * * *